US006702374B2

(12) United States Patent
Kams

(10) Patent No.: US 6,702,374 B2
(45) Date of Patent: Mar. 9, 2004

(54) PROTECTIVE COVER FOR A CHILD CARRIER

(76) Inventor: Martin T. Kams, 11180 Sommerside Ave., Alta Loma, CA (US) 91737

( * ) Notice: Subject to any disclaimer, the term of this patent is extended or adjusted under 35 U.S.C. 154(b) by 0 days.

(21) Appl. No.: 09/812,160

(22) Filed: Mar. 14, 2001

(65) Prior Publication Data

US 2002/0130536 A1 Sep. 19, 2002

(51) Int. Cl.[7] ..... A47C 29/00

(52) U.S. Cl. ..... 297/184.13; 297/184.11; 135/93; 52/3

(58) Field of Search ..... 297/184.1, 184.11, 297/184.13, 184.14, 184.17, 219.12, 250.1, 183.3; 135/913, 93, 115; 52/3

(56) References Cited

U.S. PATENT DOCUMENTS

| | | | | | |
|---|---|---|---|---|---|
| 326,872 | A | * | 9/1885 | Johnston | 135/913 X |
| 356,015 | A | * | 1/1887 | Steinberg | 135/913 X |
| 674,920 | A | * | 5/1901 | Jones | 135/913 X |
| 1,003,370 | A | * | 9/1911 | Priest | 135/913 X |
| 1,007,829 | A | * | 11/1911 | Westbrook | 135/913 X |
| 2,659,905 | A | * | 11/1953 | Rochford | 135/913 X |
| 3,477,453 | A | * | 11/1969 | D'Ulisse | 135/913 X |
| 4,946,221 | A | | 8/1990 | Livingston | |
| 5,074,616 | A | * | 12/1991 | Smith | 297/184.13 |
| 5,188,380 | A | * | 2/1993 | Tucek | 297/184.17 X |
| 5,522,639 | A | * | 6/1996 | Jaime | 297/184.13 |
| 5,662,379 | A | | 9/1997 | Zimelman | |
| 5,716,095 | A | * | 2/1998 | Lopez | 297/184.13 |
| 5,730,490 | A | | 3/1998 | Mortenson | |
| 5,806,924 | A | | 9/1998 | Gonas | |
| 6,039,393 | A | | 3/2000 | Roh | |

* cited by examiner

*Primary Examiner*—Peter M. Cuomo
*Assistant Examiner*—Stephen Vu
(74) *Attorney, Agent, or Firm*—Knobbe, Martens, Olson & Bear, LLP

(57) ABSTRACT

A protective cover for child carriers having a rigid, concave shell is configured to shield the child from projectiles such as balls, rocks, and the like. The shell also comprises a plurality of openings that are dimensioned to permit air to flow freely therethrough while the cover shields the child from projectiles. The cover also comprises at least one attachment device which is adapted to detachably affix the cover to most conventional child carriers.

22 Claims, 3 Drawing Sheets

PROTECTIVE COVER FOR A CHILD CARRIER

BACKGROUND OF THE INVENTION

1. Field of the Invention

The present invention relates to child carriers and, more particularly, to a protective cover that fits over the child carrier and shields the child from projectiles such as stray balls during sporting events.

2. Description of the Related Art

Infants and small children are often placed in child carriers while they are transported from one location to another. Most conventional child carriers are comprised of an open shell having two opposing side walls and a bottom panel covered with padding. The child is usually placed on the padded bottom panel of the carrier in a manner that leaves the child's face and body openly exposed. These child carriers are also sometimes used as portable seats to hold small children when they are taken outdoors to events such as picnics or ball games. However, one disadvantage of seating infants and small children in such carriers during sporting events is that they are susceptible to being hit by projectiles such as stray balls. In particular, high speed stray balls can hit the child before the adult has time to react and remove the child from the path of the moving ball.

The prior art discloses a number of modified child carriers that have protective shields configured to protect children while they are seated in the carrier. However, these carriers are primarily designed to protect children from impact with airbags. For instance, the prior art discloses child carriers equipped with clear plastic doors that can be closed over the top opening of the carrier so as to completely enclose the child within the carrier. While such plastic covers will generally shield the child from airbags and most projectiles, they tend to reduce air circulation to the child and thus deprive the child of adequate ventilation and comfort. In particular, it can be quite uncomfortable for the child when the child is left outdoors in such an enclosure for an extended period of time on a hot day. Moreover, the child's breath will likely fog the plastic cover thereby making it difficult for the child to see out and adults to see inside.

In certain instances, the plastic cover can also create a feeling of claustrophobia in some children when they realize that they cannot reach out beyond the sheet of plastic that is immediately adjacent their body. Furthermore, the plastic cover can also shatter upon impact when it is hit by certain high speed projectiles which may result in substantial injury to the child. Additionally, these modified child carriers typically have to be purchased separately as the conventional child carriers cannot be retrofitted to include such protective covers.

Therefore, it can be appreciated that there is a need for a protective cover for child carriers that will shield the child from flying projectiles and yet does not reduce the child's ventilation and comfort. Furthermore, it can be appreciated that there is a need for a protective cover that can be easily retrofitted on most conventional child carriers. To this end there is a need for a protective cover that protects the child from flying projectiles, does not limit the child's ventilation and comfort, and can be adapted for use on most conventional child carriers.

SUMMARY OF THE INVENTION

The aforementioned needs are satisfied by the child carrier protective cover of the present invention which is adapted to shield the child from projectiles such as balls, rocks, and the like while still providing the child with sufficient ventilation and comfort.

In one aspect, the protective cover comprises a rim that is adapted to surround a child seated in the child carrier. The protective cover further comprises a shield extending from the rim so as to form a concave shell and define a space therein. Preferably, the shield is sized to enclose the child in the space and protect the child from contact with projectiles. Furthermore, the shield defines a plurality of openings that extend substantially throughout the entire shield. The openings permit air to circulate therethrough and allow for improved visibility so that the child is visible to others while seated in the carrier.

In one embodiment, the rim of the protective cover comprises a first section defining a first plane and a second section defining a second plane wherein the first plane is tilted at an angle to the second plane. Preferably, the angle of tilt between the first and second planes defined by the rim is approximately 145 degrees. In another embodiment, the space defined by the shield is substantially rectangular and has a width of approximately 14.5–15 inches, a length of approximately 35–36 inches, and a maximum height of approximately 12.5 inches.

In yet another embodiment, the shield is comprised of a mesh formed by a network of wires. The mesh can be constructed of a known metal such as steel, aluminum and the like or a plastic material or a powder coated metal material. Furthermore, the mesh comprises substantially evenly spaced openings wherein each opening has an area of approximately 1 $in^2$ while the space between adjacent openings is preferably 1/16 inch, more preferably 1/8 inch, more preferably 1/4 inch. Furthermore, the openings are configured to permit the child's fingers and toes to extend out from the openings so as to provide the child with a sense of openness and contact with outside while still preventing entry of large projectiles such as balls.

In yet another embodiment, the protective cover further comprises at least one attachment device wherein the at least one attachment device is configured to detachably affix the cover to the child carrier. Preferably, the at least one attachment device comprises a first and second strap wherein the first strap is affixed to a front section of the rim and the second strap is affixed to a rear section of the rim.

In another aspect, the protective cover of the present invention comprises a rim that is adapted to rest on an outer periphery of the child carrier. The cover further comprises a network of wires extending from the rim so as to form a rigid mesh. Preferably, the mesh comprises a plurality of substantially evenly spaced openings so as to permit air to flow free therethrough. Preferably, the openings are also dimensioned to permit the child's fingers and toes to reach out through the openings and make contact with outside. Furthermore, the cover also comprises a plurality of elastic straps that are configured to attach the cover to a child carrier. Preferably, the straps can be easily attached and removed from the frame of most conventional child carriers.

In yet another aspect, the present invention comprises a child carrier having a protective cover. In one embodiment, the child carrier comprises an open shell having a plurality of side walls and a padded bottom panel that is adapted to receive a child. Furthermore, the child carrier comprises a protective cover having a rim, a network of wires extending from the rim so as to form a concave shield and define a space therein. Preferably, the protective cover is adapted to rest on an upper surface of the side walls of the open shell while the child is positioned on the padded bottom panel of the carrier. Preferably, the child is enclosed in the space defined by the network of wires so as to be protected from contact with projectiles. In addition to shielding the child, the network of wires also form a plurality of openings that permit air to circulate to the child.

In yet another aspect, the present invention comprises a protective cover assembly for a child carrier wherein the assembly comprises an interlocking mesh of rigid wires defining a plurality of openings arranged in a pattern wherein the plurality of openings have a width of at least one inch. The cover assembly further comprises an attachment mechanism that attaches to the interlocking mesh of rigid wires and is adapted to engage with the child carrier so as to retain the interlocking mesh of rigid wires on the child carrier wherein the interlocking mesh of rigid wires when attached to the child carrier define an interior volume having a depth of at least 12.5 inches.

Advantageously, the child carrier protective cover of the present invention shields a child seated in the carrier from projectiles such as balls, rocks, and the like without reducing the ventilation or comfort of the child. In particular, the protective cover comprises a plurality of openings that are configured to permit air to flow freely therethrough while the cover shields the child from projectiles. Furthermore, the numerous openings in the cover provide the child with a sense of openness so that the child will not likely develop a feeling of claustrophobia. Moreover, the protective cover can be adapted for use on most conventional child carriers. These and other advantages of the present invention will become more apparent from the following description taken in conjunction with the following drawings.

DETAILED DESCRIPTION OF THE PREFERRED EMBODIMENTS

Reference will now be made to the drawings wherein like numerals refer to like parts throughout. As will be described herein below, the child carrier protective cover of the preferred embodiment shields the child from projectiles and yet does not reduce the child's ventilation or comfort, and can be conveniently adapted for use on most conventional child carriers.

Figure 1:
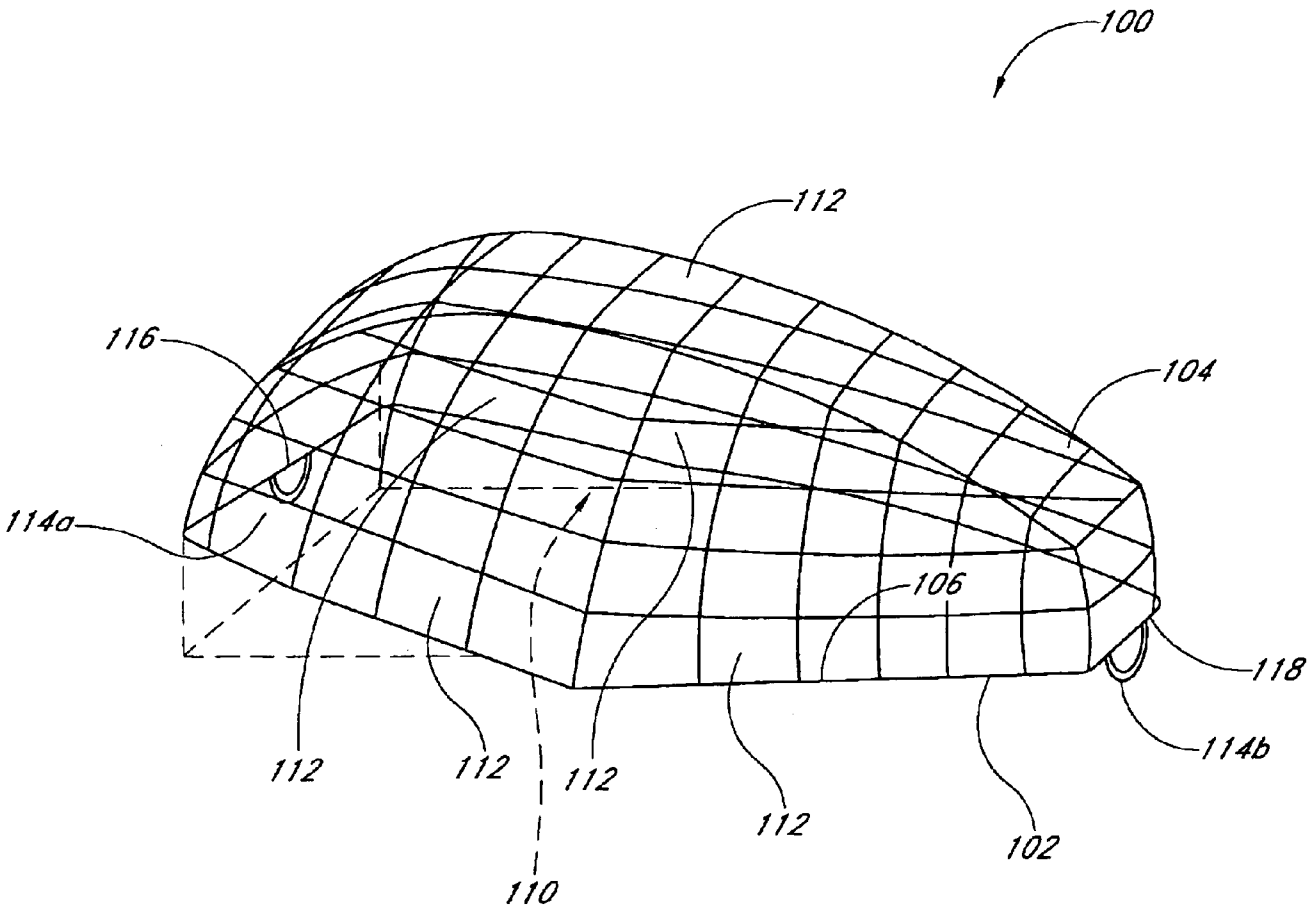
FIG. 1 illustrates a perspective view of the child carrier protective cover of the preferred embodiment.

FIG. 1 illustrates a child carrier protective cover 100 of the preferred embodiment. As shown in FIG. 1, the protective cover 100 generally comprises a rim 102 and a shield 104 that extends from an upper surface 106 of the rim 102 so as to form a concave shell and define a space 110 therein. As will be described in greater detail below, the cover 100 is configured to fit over a child carrier in a manner such that the child seated in the carrier will remain in the space 110 defined by the shield 104 and be substantially protected from projectiles.

As FIG. 1 further illustrates, the shield 104 comprises a plurality of evenly spaced openings 112 that are dimensioned to permit air to flow freely therethrough so as to provide the child with adequate ventilation and comfort. Preferably, the openings 112 are configured to keep projectiles and moving objects such as baseballs and the like from falling through the openings 112 and injure the child. In one embodiment, each opening 112 is substantially square shaped and has an area of approximately 1 $in^2$. However, it can be appreciated that the openings may also take on a variety of other shapes and dimensions without departing from the spirit of the invention.

Furthermore, the shield 104 is constructed of a rigid material that can withstand the force of impact with projectiles such as baseballs, soccer balls, rocks, or the like. In one embodiment, the shield 104 is comprised of a mesh formed by a network of wires in which each wire has an outer diameter of approximately ⅛ inch. Preferably, the wires can be constructed of known metals such as steel aluminum and the like, or a known plastic material. In one embodiment, metal wires are powder coated using generally known techniques so as to provide the wires with a soft edge that is more suited for a child to grab onto. Advantageously, the shield 104 protects the child from most flying projectiles while the numerous openings 112 in the shield 104 permit air to flow freely to the child and allow for improved visibility. Preferably, the openings 112 comprise at least fifty percent (50%) of the total surface area of the protective cover 100 so as to ensure sufficient air circulation to and from the child. Thus, the child's ventilation and comfort will not be compromised, particularly when the child is placed in the carrier and taken outdoors on a hot day.

Furthermore, the protective cover 100 also reduces the feeling of claustrophobia that some children may otherwise experience when they are enclosed in child carriers equipped with conventional protective covers. In particular, the cover 100 is contoured to provide sufficient room for the child's hands and legs to move within the space 110 defined by the shield 104. Furthermore, the numerous openings 112 in the cover 100 provide the child some contact with outside so that the child is not likely to feel completely isolated once the cover 100 is placed over the carrier.

As it is also shown in FIG. 1, a plurality of attachment devices 114*a*, 114*b* are affixed to the cover 100 and adapted to detachably affix the cover 100 to a child carrier. In one embodiment, the attachment devices 114*a*, 114*b* comprises U-shaped straps that are attached to a front 116 and rear 118 sections of the rim 102 and can be conveniently slipped onto the frame of a child carrier. Preferably, the straps are made of an elastic material and are configured to fit on a conventional child carrier in a manner to be described in greater detail below.

Figure 2A:
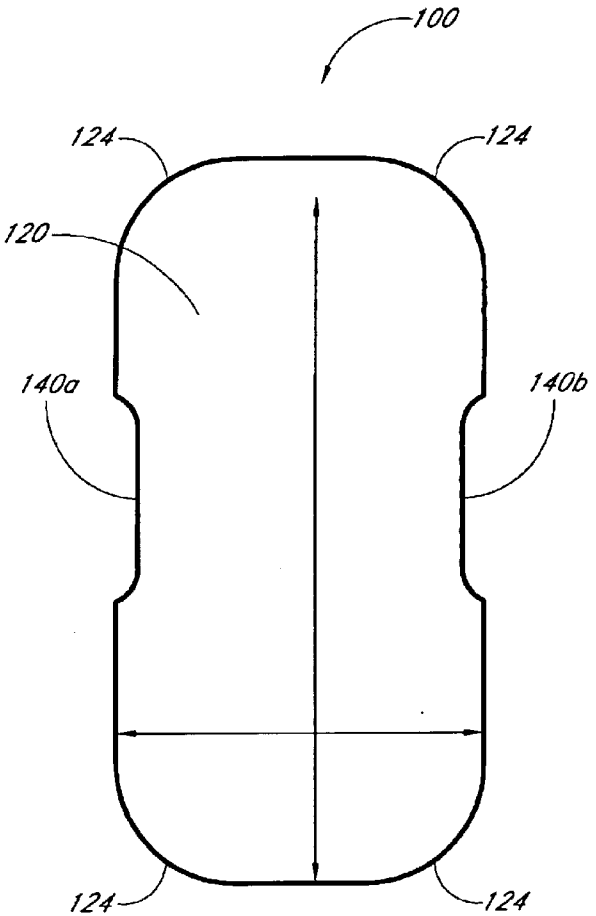
FIG. 2A illustrates a schematic top view of the child carrier protective cover of FIG. 1.

FIG. 2A shows a schematic top view of one embodiment of the protective cover 100 of the present invention. As FIG. 2A illustrates, the protective cover 100 forms a substantially rectangular enclosure 120 having rounded corners 124. The shape and dimension of the cover 100 is configured in accordance with the design of most conventional child carriers so that the cover can be conveniently adapted for use on these carriers. In one embodiment, the enclosure 120 is approximately 35–36 inches long and 14.5–15 inches wide, which corresponds to the dimensions of many conventional child carriers. However, the shape and dimension of the enclosure 120 formed by the cover 100 can vary without departing from the scope of the invention. As FIG. 2A further illustrates, in one embodiment, the protective cover 100 forms a substantially rectangular enclosure 120 having a plurality of cutouts 140*a*, 140*b*. The cutouts 140*a*, 140*b* are configured to permit the protective cover 100 to properly fit on the child carrier. In particular, the cutouts 140*a*, 140*b* are contoured in a manner so that the protective cover 100 can fit around the base of the handle on most child carriers.

Figure 2B:
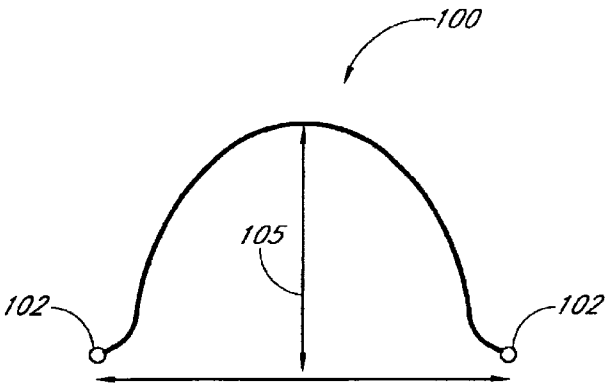
FIG. 2B illustrates a schematic cross-sectional front view of the child carrier protective cover of FIG. 1.
Figure 2C:
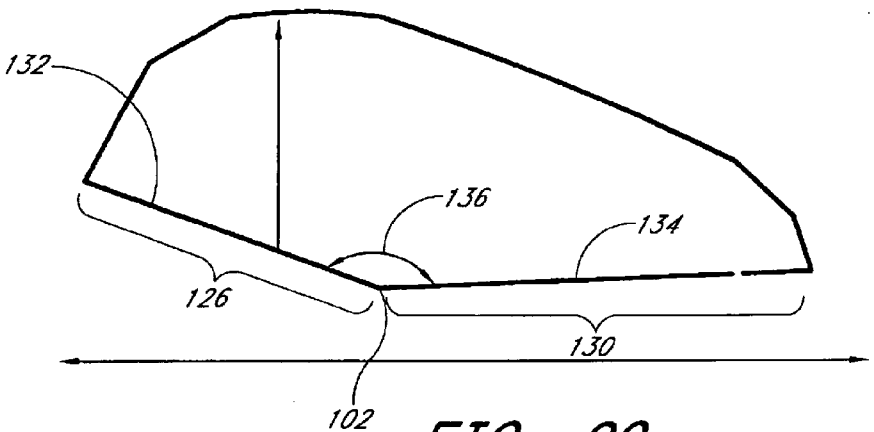
FIG. 2C illustrates a schematic side view of the child carrier protective cover of FIG. 1.

FIG. 2B illustrates a front cross-sectional view of one embodiment of the protective cover 100. As FIG. 2B illustrates, the cover 100 is bulbous shaped and the distance 105 from the rim 102 of the cover 100 to the apex of the shield 104 is approximately 12.5 inches. This distance 105 provides some headroom for the child's arms and legs to move while seated in the carrier. FIG. 2C illustrates a schematic side view of one embodiment of the protective cover 100. As FIG. 2C illustrates, a front section 126 of the rim 102 defines a first plane 132 while a rear section 130 of the rim 102 defines a second plane 134. Furthermore, the first plane 132 is tilted at an angle 136 from the second plane 134 such that the angle 136 is adapted to correspond to the angle that is typically present between the front and rear sections of most conventional child carriers. In one embodiment, the angle 136 comprises an obtuse angle of approximately 145 degrees. The angle 136 of bend in the rim 102 is configured to simulate the angle typically present in most conventional child carriers so as to ensure that the cover 100 can be properly fitted over the carrier 100. Furthermore, when the protective cover 100 is engaged with a child carrier in a manner to be described in greater detail below, the protective cover defines an interior volume having a depth of at least 12.5 inches.

Figure 3:
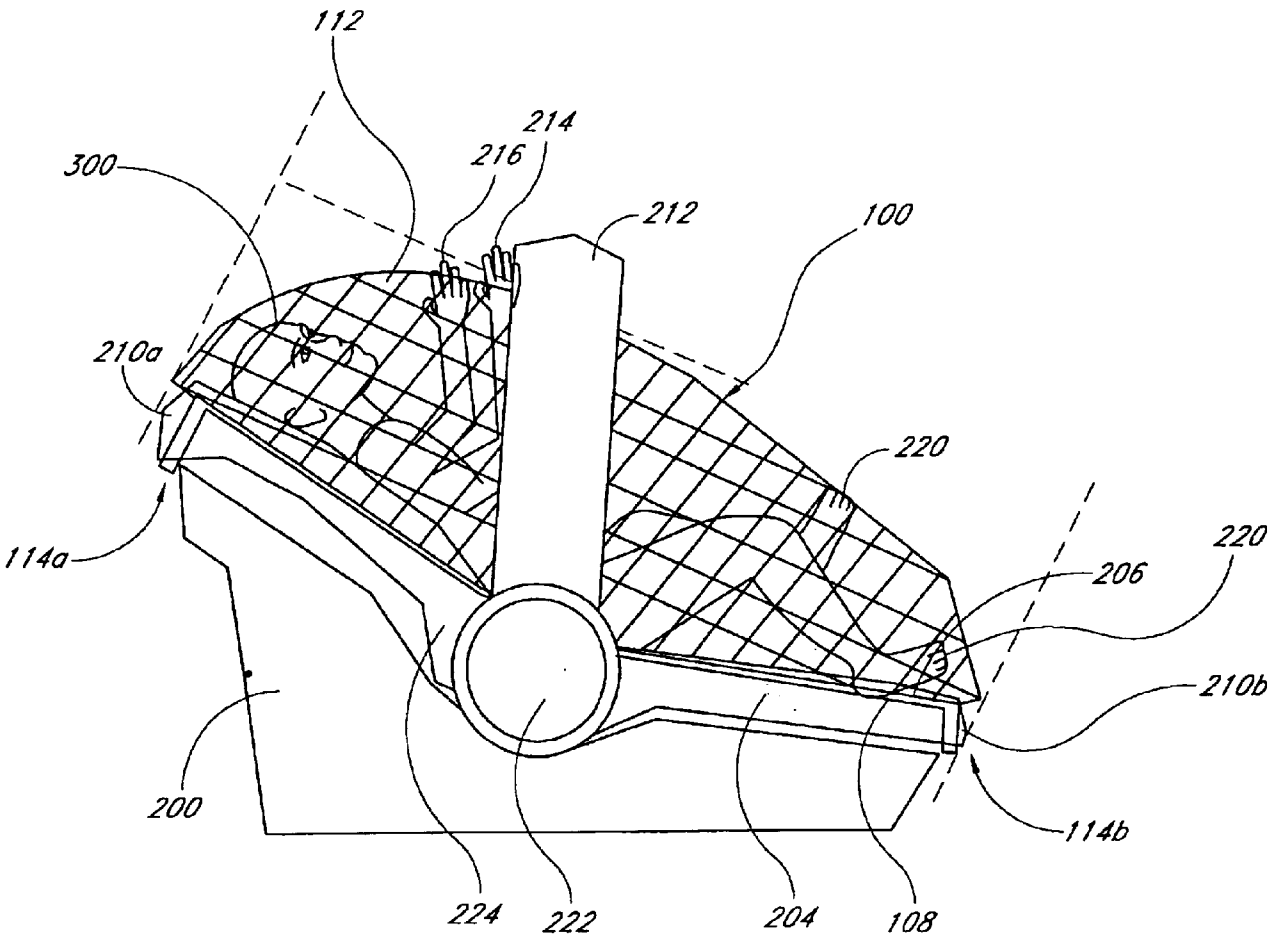
FIG. 3 illustrates the protective cover of FIG. 1 being placed on a conventional child carrier.

FIG. 3 illustrates the manner in which the protective cover 100 is engaged with a conventional child carrier 200. As FIG. 3 shows, the rim 102 of the cover 100 is positioned adjacent an outer periphery 204 of the child carrier 200. In one embodiment, a lower surface 108 of the rim 102 rests on an upper surface 206 of the outer periphery 204 of the carrier 200 while the plurality of straps 114*a*, 114*b* are slipped over an upper and lower edge 210*a*, 210*b* of the child carrier 200 to detachably affix the cover 100 to the carrier 200. Preferably, the straps 114*a*, 114*b* permit the cover 100 to be easily attached to and removed from the child carrier 200. In one embodiment, the straps 114*a*, 114*b* are made of an elastic material so that they can fit snugly around the upper and lower edges 210*a*, 210*b* of the child carrier 200. Furthermore, the elastic straps can fit around mounting edges having a variety of different configurations, thus permitting the child carrier protector to be mounted to a variety of different child carriers.

As FIG. 3 further shows, the cover 100 is contoured to maximize the headroom for the child 300 seated in the carrier while still providing sufficient space for a handle 212 of the carrier 200 to be deployed over the cover 100 in a manner such that the carrier 200 can be picked up via the handle 212. In one embodiment, the handle 212 is substantially U-shaped and has a first end 222 attached to a first side 224 of the child carrier 200 and a second end (not shown) attached to a second side of the carrier. As described above, the protective cover has cutouts that are configured to fit around the first and second ends of the carrier. In another embodiment, toys 214 can be placed along the openings 112 of the cover 100 so that the child 300 can be entertained while seated in the child carrier. Furthermore, the child's fingers 216 and toes 220 can reach through the openings 112 to the outside so as to minimize the sense of claustrophobia the child may feel.

Advantageously, the protective cover shields the child from most projectiles and yet provides a feeling of openness. In particular, the cover is designed to shield the child from projectiles such as balls, rocks, and the like and the force of the object hitting the cover will be transmitted to the carrier and not to the child sitting therein. Moreover, the cover has sufficient openings to permit air to flow freely to and from the child so that the child's ventilation and comfort are not reduced. Furthermore, the protective cover can be easily adapted for use on most conventional child carriers, including but not limited to child car seats, strollers, and infant carriers.

Although the foregoing description of the preferred embodiment of the present invention has shown, described and pointed out the fundamental novel features of the invention, it will be understood that various omissions, substitutions, and changes in the form of the detail of the apparatus as illustrated as well as the uses thereof, may be made by those skilled in the art, without departing from the spirit of the invention. Consequently, the scope of the present invention should not be limited to the foregoing discussions, but should be defined by the appended claims.

What is claimed is:

1. A child carrier assembly with protective cover comprising:

a child carrier defining a seat having a front section and a back support section that is angled with respect to the base section so that the child is supported in at least a partially sitting-up posture wherein the child carrier includes a U-shaped handle having a first and second end attached to the carrier to thereby allow the carrier to be carried by the U-shaped handle;

a rim that is adapted to surround a child seated in the child carrier wherein the rim includes a front section that is positioned adjacent to the front section of the child carrier and a rear section that is angled with respect to the front section so that the rear section is positionable adjacent to the back support section of the child carrier and wherein the rim includes a plurality of cutouts that are configured to fit around the first and second ends of the handle when the protective cover is detachably affixed to the child carrier;

a shield extending from the rim so as to form a concave shell and define a space therein wherein the shield is sized to enclose the child in the space and is formed of a rigid material to protect the child from contact with projectiles wherein the shield defines a plurality of openings that extend substantially throughout the entire shield and permit air to circulate therethrough and allow for improved visibility so that the child is visible to others when seated in the carrier; and an attachment assembly that detachably affixes the cover to the child carrier wherein the attachment assembly comprises a first and second strap, wherein the first strap is affixed to the front section of the rim and the second strap is affixed to the rear section of the rim.

2. The protective cover of claim 1 wherein the rim comprises a first section defining a first plane and a second section defining a second plane, wherein the first plane is tilted at an angle forward the second plane.

3. The protective cover of claim 2 wherein the angle of tilt between the first and second planes defined by the rim is approximately 145 degrees.

4. The protective cover of claim 1 wherein the shield comprises a mesh formed by a network of wires.

5. The protective cover of claim 4 wherein the mesh is constructed of a metal material.

6. The protective cover of claim 5 wherein the metal material comprises steel.

7. The protective cover of claim 5 wherein the metal material comprises aluminum.

8. The protective cover of claim 4 wherein the mesh is constructed of a plastic material.

9. The protective cover of claim 4 wherein each opening in the shield is approximately 1 $in^2$, wherein the openings are substantially evenly spaced and the space between adjacent openings is approximately ⅛ inch.

10. The protective cover of claim 4 wherein the openings in the shield are configured so that the child's toes and fingers can extend out from the openings.

11. The protective cover of claim 1 wherein the openings in the shield comprise at least fifty percent (50%) of the total surface area of the shield.

12. The protective cover of claim 1 wherein the space defined by the shield is substantially rectangular and has a width of approximately 14.5–15 inches, a length of approximately 35–36 inches, and a maximum height of approximately 12.5 inches.

13. A child carrier protective cover for protecting a child seated in the child carrier having a handle that extends from the child carrier from projectiles while permitting air to flow freely to and from the child, the protective cover comprising:

a rim that is adapted to rest on the outer periphery of the child carrier that has a first and a second end, wherein the rim is contoured to include indentations to fit around a portion of the handle at an attachment point where the handle extends from the child carrier when the protective cover is detachably affixed to the child carrier;

a network of rigid wires extending from the rim so as to form a rigid shield, wherein the shield is formed of rigid wires to protect the child from contact with projectiles when the rim is positioned on the outer periphery of the child carrier, wherein the shield comprises a plurality of substantially evenly spaced openings positioned across the shield, wherein the openings permit air to circulate therethrough while the shield is protecting the child; and an attachment assembly that is adapted to detachably secure the first and second ends of the rim to the child carrier so as to secure the rigid shield to the child carrier.

14. The child carrier protective cover of claim 13 wherein the shield comprises a plurality of openings that permit the child's fingers and toes to reach through the openings.

15. The child carrier protective cover of claim 14 wherein the protective cover further comprises a plurality of elastic straps configured to attach the cover to the child carrier.

16. The protective cover of claim 14 wherein the network of wires comprises a metal material.

17. A child carrier having a protective shield comprising:

an open shell having a plurality of side walls and a padded bottom panel that is adapted to receive a child;

a U-shaped handle having a first end attached to a first side and a second end attached to a second side of the shell wherein the handle can be deployed in a substantially vertical position while the protective cover is detachably affixed to the child carrier;

a protective cover having a rim, a network of rigid wires extending from the rim so as to form a concave shield and define a space therein, wherein the protective cover is adapted to rest on an upper surface of the side walls of the open shell and enclose the child in the space defined by the network of rigid wires, wherein the network of wires form a plurality of openings that permit air to circulate therethrough and are sized to permit the child's toes and fingers to extend out from the plurality of openings and wherein the protective cover is configured with a plurality of cutouts configured to fit around the first and second ends of the U-shaped handle when the protective cover is detachably affixed to the child carrier; and a plurality of attachment devices adapted to detachably secure the protective cover to the open shell.

18. The child carrier of claim 17 wherein the protective cover of the child carrier is detachably affixed to the child carrier via a plurality of attachment devices.

19. The child carrier of claim 17 wherein the network of wires form a plurality of openings that are substantially evenly spaced, wherein each opening is positioned approximately ⅛ inch from adjacent openings.

20. The child carrier of claim 19 wherein each of the openings is substantially square shaped having an area of approximately 1 $in^2$.

21. The child carrier of claim 19 wherein the network of wires is comprised of a rigid metal material.

22. The child carrier of claim 19 wherein the network of wires is comprised of a rigid plastic material that can withstand impact with projectiles and protect the child from contact with the projectiles.

* * * * *